United States Patent [19]

Buyak

[11] Patent Number: 4,954,805

[45] Date of Patent: Sep. 4, 1990

[54] PIEZO ELECTRONIC HORN

[75] Inventor: William P. Buyak, New Hartford, Conn.

[73] Assignee: General Signal Corporation, Stamford, Conn.

[21] Appl. No.: 475,541

[22] Filed: Feb. 6, 1990

[51] Int. Cl.[5] ..... G08B 3/00

[52] U.S. Cl. ..... 340/384 E; 340/384 R; 340/530; 340/692

[58] Field of Search ..... 340/384 R, 384 E, 512, 340/513, 530, 692

[56] References Cited

U.S. PATENT DOCUMENTS 4,558,305 12/1985 Black et al. .

4,594,573 6/1986 Yoshino et al. .

*Primary Examiner*—Donnie L. Crosland

*Attorney, Agent, or Firm*—Robert R. Hubbard; William G. Miller, Jr.

[57] ABSTRACT

The invention provides an electronic horn for an alarm circuits of the type in which the d.c. power supply for the horn will be of a particular polarity to indicate an alarm condition. The circuit provides a piezo sounder connected across the terminals of the power supply, an inductor connected in parallel with the piezo sounder to form a tank circuit therewith and current modifying means connected in series with the tank circuit to modify the current through the tank circuit in response to the output of an R/S flip-flop which is periodically set by a clock signal at a frequency corresponding to the frequency desired for the fundamental audible tones of the sounder. The duration of the clock output pulse which makes the modifying means conductive must be such that the capacitance of the sounder is charged by the supply before the output of the clock permits a change of state in the flip-flop to make the modifying means nonconductive. A source of reset signals is connected to detect the current in the series circuit and is operable to produce a reset signal which will cause the change of state to thereby cut off the current through the tank circuit when the current detected exceeds a predetermined value after changing the sounder capacitance, at which time the tank circuit will go into a decaying oscillation to provide overtones in the sound output. Current through the tank circuit is limited during the charging of the sounder and current through a capacitor used for smoothing the supply is also limited by another current modifying means in circuit with the smoothing capacitor and the supply.

9 Claims, 2 Drawing Sheets

PIEZO ELECTRONIC HORN

BACKGROUND OF THE INVENTION

This invention relates to electronic alarm devices such as are used in the fire protection industry. More particularly, it relates to piezo electronic alarm horns which use piezo crystal sounders, and particularly in alarm systems of the type in which an alarm condition is indicated by a reversal of the polarity on the d.c. power supply to the horn.

There has developed a need to improve alarm horns and particularly a need to improve their electrical efficiency while at the same time reducing their cost. These improvements, of course, must not jeopardize the applicable standards for constancy of sound level output under varying supply voltages. Since a higher electrical efficiency will result in a lower operating line current, the number of units a particular fire alarm control panel can power will increase. If at the same time one can design a unit which will operate on both the standard 12 volt d.c. system as well as the standard 24 volt d.c. system, then the units can also be made less expensive.

Underwriters Laboratory specifications require that operation of these devices must continue when the supply voltage drops by as much as 80% of the nominal value and also when it rises to 110% of the nominal value. Thus, in the lower voltage range the unit must operate between 8 and 13.2 volts, and in the upper voltage range it must operate in the range between 16 and 26.4 volts. In order to cover both ranges the device must, therefore, be operable over the range between 8 and 26.4 volts. It is also a requirement of UL specifications that the sound output of the horn cannot decrease by more than 3 db over the range of 8–26.4 volts d.c.

It was determined that costs could be reduced if it was possible to use piezo sounders to provide audible output in electronic horns of this type, for they are much cheaper than electromagnetic horns. Typically, piezo sounder have been directly connected to oscillators as the source of energy, as is shown in U.S. Pat. No. 4,558,305 issued to Black et al.; or they have been connected as a self-excited audio transducer, as shown in U.S. Pat. No. 4,594,573, issued to Yoshino et al. Such arrangements, however, tend to produce a single frequency sound which is unsatisfactory for fire alarm systems.

It is an object of this invention to provide a circuit design for an inexpensive electronic horn which will be useful in both 12 volt and 24 volt systems, and one which will be very efficient electrically so as to minimize the current requirements for the power supply. It is a further object of this invention to maintain a constant and sufficient sound output having a suitable range of overtones even though the supply voltage may vary between 8 and 26.4 volts d.c.

SUMMARY OF THE INVENTION

The invention provides an electronic horn for an alarm circuits of the type in which the d.c. power supply for the horn will be of a particular polarity to indicate an alarm condition. The circuit provides a piezo sounder connected across the terminals of the power supply, an inductor connected in parallel with the piezo sounder to form a tank circuit therewith and current modifying means connected in series with the tank circuit to modify the current through the tank circuit in response to the output of an R/S flip-flop which is periodically set by a clock signal at a frequency corresponding to the frequency desired for the fundamental audible tones of the sounder. The duration of the clock output pulse which makes the modifying means conductive must be such that the capacitance of the sounder is charged by the supply before the output of the clock permits a change of state in the flip-flop to make the modifying means nonconductive. A source of reset signals is connected to detect the current in the series circuit and is operable to produce a reset signal which will cause the change of state to thereby cut off the current through the tank ciruit when the current detected exceeds a predetermined value after charging the sounder capacitance, at which time the tank circuit will go into a decaying oscillation to provide overtones in the sound output.

In one form of the invention the voltage on the input terminal of the current modifier is itself modified by a transistor circuit so that during the charging of the sounder the current in the series circuit is limited.

In another form of the invention a capacitor is supplied across the power supply terminals to smooth out the supply. In order to limit the inrush current of that capacitor a current limit circuit is supplied which is effective to modulate the current flow in that capacitor so that only a limited current is drawn from the supply when an alarm condition is first initiated.

BRIEF DESCRIPTION OF THE DRAWINGS

In the drawings, in which like elements have like reference characters.

DESCRIPTION OF THE PREFERRED EMBODIMENTS

Figure 1:
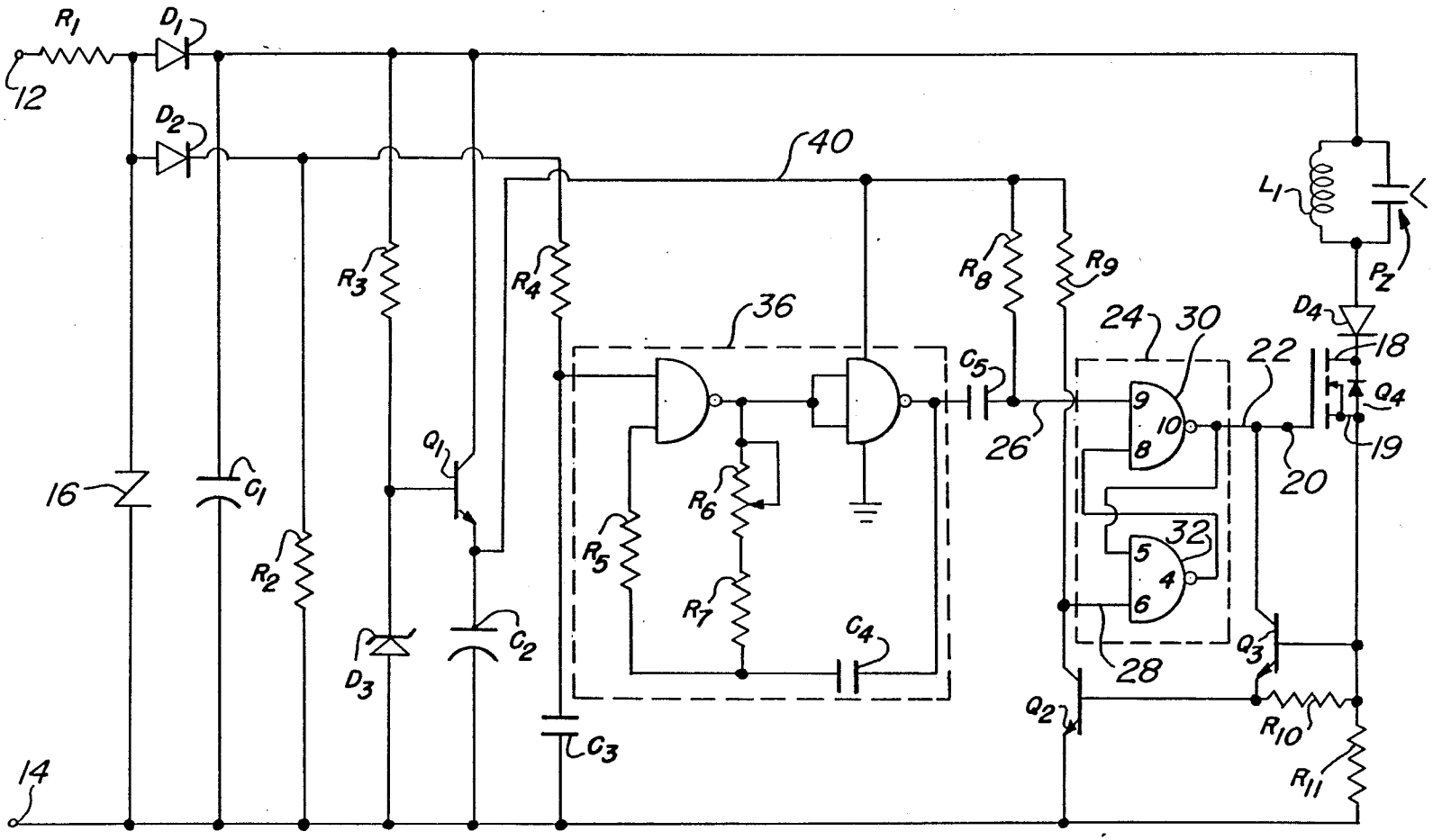
FIG. 1 is a circuit diagram of one form of the invention.

It was the desire of the present inventor to use a piezo sounder to provide the audible output for a fire alarm, for as mentioned above those elements are less expensive than electromagnetic horns and are also more efficient thus presenting the possibility that a more efficient horn could be produced.

Since known piezo sounder circuits produce only a single tone which is not adequate for a fire alarm, it is necessary to overcome that deficiency. This accomplished by utilizing an inductor in parallel with the piezo sounder to form a tank circuit, switching the tank circuit across the supply periodically and disconnecting from the supply when the inductor has been charged to a predetermined energy level. The switching is at a frequency such that it produces in the sounder the fundamental tone of the audible output. After the sounder had been completely charged the inductor continues to charge until the current flow becomes a predetermined amount then the tank circuit is disconnected from the supply and is allowed to go into a decaying oscillation at a frequency which will supply overtones to the audible output. That frequency is preferably at the same frequency as the natural resonance of the sounder so that maximum sound output can be obtained.

Availability of a current control circuit of the type disclosed in U.S. patent application Ser. No. 07/303,887, suggested the possibility of using that circuit as the means for establishing the fundamental tone. It was realized, however, that the possibility of using that circuit would not meet with success, for piezo sounders are essentially capacitive elements, hence the charging current of the sounder would tend to cause an immediate reset of the flip-flop which does the cycling. That would cause the sound to be turned off immediately after it was turned on, thus making operation with a piezo sounder impossible. It was, therefore, found to be necessary to invent an arrangement which would prevent the resetting of the flip-flop in response to the charging current of the sounder. The novel solution developed to solve this problem involves the increase of the time constant of the RC circuit connected to the output of the oscillator by a factor of five so that the logical input to the flip-flop will be a pulse of duration sufficient to allow substantially complete charging of the sounder before that pulse disappears.

It was also believed to be desirable to produce a unit which would be useful in both the 12 and 24 volt systems and to limit the current flow in the sounder and in other capacitive elements during the initial part of their charging so as to minimize the current drawn from the supply. This required the invention of one form of current limiter for the sounder and another form for the capacitor which is used to smooth out the supply variations. As will be evident from the description of the preferred embodiments set forth below, all of these objectives have been realized by the circuits of the present invention.

In FIG. 1, the piezo sounder Pz which produces the audible sound for the horn is connected in parallel with an inductor $L_1$ form a tank circuit having natural resonance at about 2.5 to 3 KHZ. The tank circuit is connected across power supply terminals 12 and 14 through a series circuit which is shown as including a resistor $R_1$, a diode $D_1$, a diode $D_4$, a current control means which includes as a current modifying means the power MOSFET $Q_4$ for modifying the current in the series circuit and the resistor $R_{11}$. The resistor $R_1$ in conjunction with the metal oxide varistor 16 serves to provide transient protection to the circuit. The diode $D_1$ effectively disconnects the circuit from the power supply when a negative potential is applied to terminal 12, the condition that exists when there is no alarm. Current will, of course, be allowed to flow from the supply when the supply polarity at terminal 12 at positive as when there is an alarm condition detected. Diode $D_4$ serves to prevent reverse currents from flowing through the intrinsic diode of $Q_4$. The resistor $R_{11}$ is used, as will be described later, to provide means for detecting the current flow in the series circuit through the sounder and/or the inductor.

The MOSFET $Q_4$ will be effective to change the conductivity of its output circuit, namely between its drain 18 and its source 19 in response to the magnitude of the voltage on line 22 to its input terminal, gate 20. A logical "1" signal on line 22 will make $Q_4$ conductive and the magnitude of that signal will determine the magnitude of the conductivity so that $Q_4$ may be used to control the current flow in the series circuit. The logical significance of the signal on the input terminal of $Q_4$ is determined by the output of another part of the current control means, the R/S flip-flop 24, on line 22, which is in turn dependent on the set input to the flip-flop on line 26 and the reset input on line 28. As will be evident from FIG. 1, the flip-flop 24 consists of two NAND gates, 30 and 32, connected in a typical flip-flop configuration so that the truth table of the flip-flop is as follows:

| FF terminals | 9 | 6 | 10 |
|---|---|---|---|
| | 0 | 1 | 1 |
| | 1 | 1 | 1 |
| | 1 | 0 | 0 |
| | 0 | 0 | 1 |

It will be evident from the above truth table that a logical "0" on the set input 26 to pin 9 will always produce a logical "1" at pin 10, the output connected to line 22. Also, it will be evident that to reset the flip-flop to change its output to a logical "0" there in required a coincidence of a logical "1" on the set input 26 to pin 9 and a logical "0" on the reset input line 28 to pin 6. One can then see that if the set input to the flip-flop has its duration extended one can prevent the output of the flip-flop from changing even though there is a reset signal applied to its reset input. Thus, the output can be kept in the logical "1" state to maintain the conductivity of $Q_4$ until the charging current due to the capacitance of the sounder has essentially subsided.

The set input to the flip-flop on line 26 is provided by the oscillator 36 in combination with the RC circuit made up of capacitor $C_5$ and resistor $R_8$ which produces a clock signal on line 26 having a waveform related to the charging of $C_5$. The oscillator 36 is made up of two NAND gates and the necessary RC networks to provide the desired frequency, 200 Hz for example, to establish the fundamental frequency of the sound heard. The RC network is shown as including resistors $R_5$ and $R_7$ and potentiometer $R_6$ as well as capacitor $C_4$. The potentiometer $R_6$ serves to adjust the frequency of the oscillator, as may be required.

An input is supplied to the oscillator 36 to enable it when the series circuit including diode $D_2$, resistor $R_4$ and capacitor $C_3$ is connected through $R_1$ for current flow from the supply terminals 12 and 14 under alarm conditions, that is when the potential at 12 is positive with respect to 14. Oscillation is inhibited when line voltage polarity is reversed. This line voltage sensing network can control the sounding of the horn, such as in accordance with a paging code. A short time constant filter is formed by $C_3$ and $R_4$ which eliminates noise transients and the effects of the full wave rectified unfiltered d.c. commonly provided by fire alarm control panels. $R_2$ plus $R_4$ provides a discharge path for capacitor $CF_3$.

The capacitor $C_1$ is provided as a means for averaging the operating line current, while at the same time providing a high peak current to operate the remaining circuits.

The transistor $Q_1$ in combination with resistor $R_3$, capacitor $C_2$ and zener diode $D_3$ provides on line 40 the output of a simple emitter follower power supply for the logic circuits.

A logical "0" clock pulses on line 26 will set the flip-flop to make the output circuit of $Q_4$ conductive, current will then flow through the sounder and the inductor. When that current increases so that the voltage drop across the resistor $R_{11}$ reaches approximately 0.55 volts, the transistor $Q_2$ is turned on and current flows from line 40 through resistor $R_9$ to cause the voltage at input 28 to drop, representing a logical "0". The flip-flop will then be reset if a logical "1" clock pulse is input to line 26. The resistor $R_{11}$, therefore, provides a means for detecting the current through the tank circuit and resistor $R_9$ in combination with transistor $Q_2$, an NPN transistor in a common emitter configuration, provides the means for producing the reset signals so that altogether they serve as a reset means for flip-flop 24.

The current modifying means also includes elements for limiting the current flow through the sounder during the period when its capacitance is being charged. These elements include a second NPN transistor $Q_3$ which has its base connected to the side of resistor $R_{11}$ which connects to the source of $Q_4$. The collector is connected to the gate of the MOSFET $Q_4$ and the emitter is connected to its base through a resistor $R_{10}$ which is also in the connection between the base of transistor $Q_2$ and the side of resistor $R_{11}$ which connects to the source of $Q_4$. The MOSFET $Q_4$ has the conductivity of its output circuit, between its source and drain, varied by the current through the collector-emitter circuit of $Q_3$, for that current will pull the voltage on gate 20 down, thus limiting the current through the sounder as it is being charged.

By way of example, the parameters of the circuits of FIG. 1 may be:

| element | value or No. |
|---|---|
| $D_1$, $D_2$ | IN4006 |
| $D_3$ | IN5242 |
| $D_4$ | IN4936 |
| $R_1$ | 10 ohms |
| $R_2$ | 150 K |
| $R_3$ | 68 K |
| $R_4$ | 22 M |
| $R_5$ | 1 M |
| $R_6$ | 100 K |
| $R_7$ | 178 K |
| $R_8$ | 470 K |
| $R_9$ | 470 K |
| $R_{10}$ | 47 ohms |
| $R_{11}$ | 2.2 ohms |
| $C_1$ | 220 microfarads |
| $C_2$ | 4.7 microfarads |
| $C_3$ | 470 picofarads |
| $C_4$ | .01 microarads |
| $C_5$ | 100 picofarads |
| $Q_1$ | 2N3417 |
| $Q_2$ | 2N3417 |
| $Q_3$ | 2N3417 |
| $Q_4$ | IRFD120 |
| 16 | V39Z1 |
| $L_1$ | 2 millihenries |
| Pz | KSN1152 |
| IC | CD4011B |

From the above, it will be evivent that the circuit of FIG. 1 operates in the manner described below.

When an alarm condition occurs the supply is positive at terminal 12 compared to terminal 14. The presence of a supply of that polarity will charge up $C_3$ to produce an input to the oscillator 36 which will start it oscillating at 200 Hz, for example. The output pulses of the oscillator will be modified by the RC circuit, made up of $R_8$ and $C_5$, so that it will produce clock pulses having a waveform determined by the charging of $C_5$ such that the flip-flop 24 will not be allowed to reset until the period of the high inrush charging current which flows through the capacitive sounder from the supply has past. Thus, a logical "0" will be presented to line 26 for the first 47 microseconds for example. A logical "0" on line 26 will cause a logical "1" on the gate 20, making $Q_4$ conductive.

As the capacitance of the sounder is charged high charging currents will occur through $R_{11}$ which will turn on transistor $Q_2$ presenting a logical "0" at reset input 28, however, since the logical "0" clock pulse is still present the flip-flop will not be reset. During this charging period the high currents are limited by the action of $Q_3$, for with $Q_2$ conductive the base current of $Q_2$, as a result of a 0.55 volt drop across $R_{10}$, is enough to turn on $Q_3$ to drag down the voltage on the gate 20 to thereby limit the current flow through the output circuit of $Q_4$. After the (47/5) approximately 10 microseconds required to charge up the capacitance of the sounder, current continues to flow in the inductor. This current is below that necessary to produce a reset signal but it builds up with time and when it becomes sufficient to cause a drop of 0.55 volts across $R_{11}$ transistor $Q_2$ is turned on causing a logical "0" on the reset input of the flip-flop at 28. The flip-flop is then reset since the first 47 microseconds has past and the clock has become a logical "1", all of which causes a logical "0" on gate 20 making $Q_4$ nonconductive.

When $Q_4$ is nonconductive the tank circuit is free to oscillate at its natural frequency, about 2.5 to 3 KHz to produce the desired overtones to enhance the fundamental tone produced by the 200 Hz oscillator. As these oscillations decay the clock pulse initiates a new cycle so that as long as the alarm condition continues the horn will produce a full bodied sound, as desired for fire alarm service.

Figure 2:
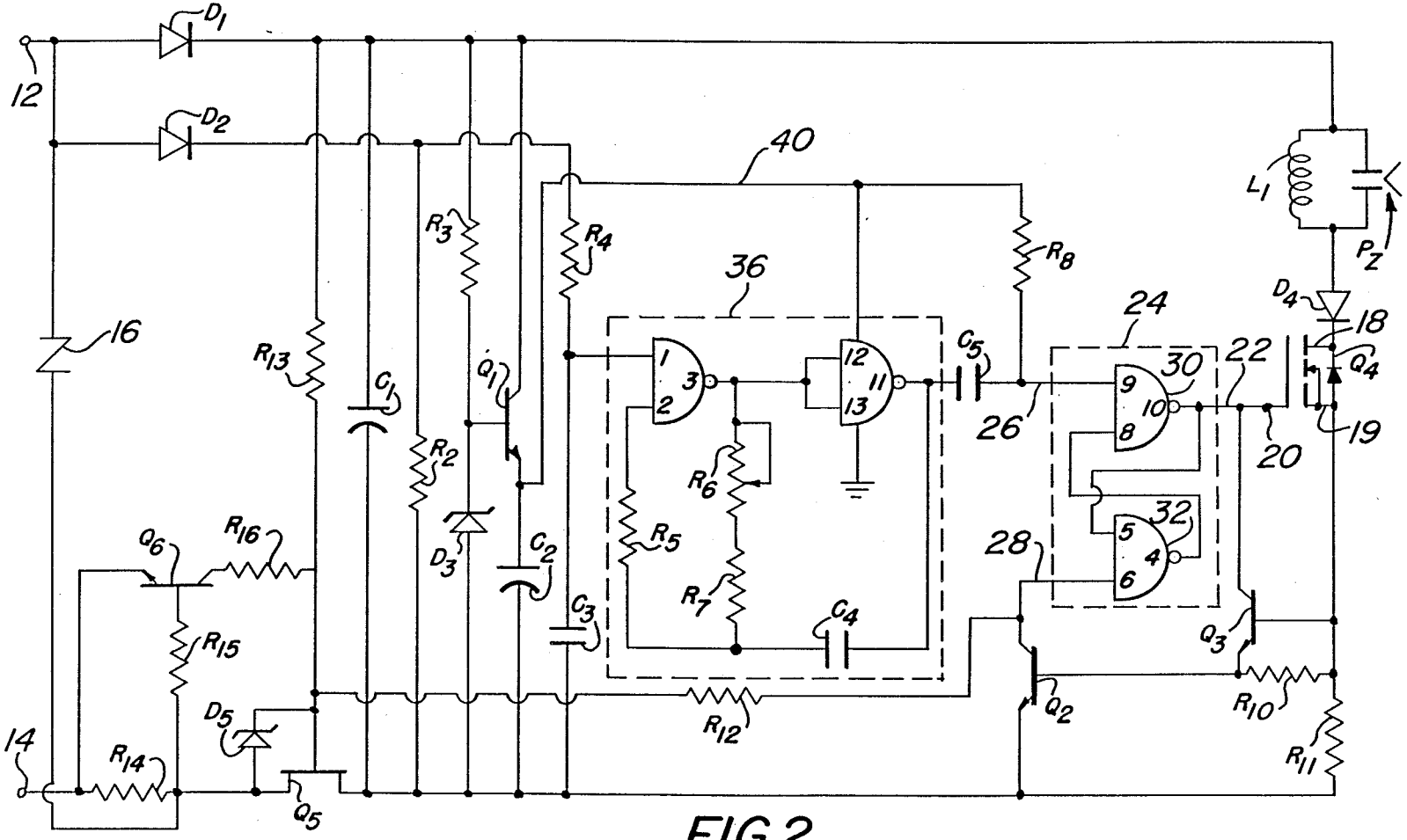
FIG. 2 is a circuit diagram of another form of the invention.

In order to provide for better limiting of the current load on the supply, the circuit of FIG. 1 can be modified as shown in FIG. 2. In this arrangement a circuit is provided which will limit the inrush current through capacitor $C_1$. In FIG. 2, the peak inrush current can exceed 2 amperes with a 24 volt supply. Such a high current could restrict the number of units which a single fire control panel could accommodate. Therefore, it is desirable to limit that current to a much lower value such as 36 milliamps, for example.

When the current through $R_{14}$ causes a voltage drop of approximately 0.55 volts, transistor $Q_6$ becomes conductive and adjusts the gate voltage on $Q_5$ to control its conductivity in such a manner as to limit the current. When $C_1$ has become charged, transistor $Q_6$ is rendered nonconductive and resistor $R_{13}$ biases $Q_5$ fully on, effectively providing a direct connection to the power supply. Resistors $R_{15}$, $R_{16}$ and zener diode $D_5$ provide over-current and voltage protection for $Q_5$ and $Q_6$.

During the interval when current is being limited, $Q_6$ is rendered conductive, essentially placing a logical "0" at the junction of $R_{13}$, $R_{12}$, $R_{16}$, etc. The logical "0" is therefore also applied to line 28 which effectively maintains $Q_4$ in a nonconductive state during the interval when the clock pulse is a logical "1" thus limiting current flow through the tank circuit to the 47 microsecond period when a logical "0" appears on line 26, which is not a period during which significant current flows in the tank circuit. This circuit action keeps the line current at a low value effectively disabling the piezo sounder during a short interval following application of power in the polarity indicating an alarm.

With the circuit of FIG. 2 it is possible to provide a horn which draws only 7 milliamps as compared with the requirement for 60 milliamps for an electromagnetic horn supplying the same decibel output. It should, therefore, be amply evident that the present invention allows for the connection of many horns to a single control panel without the necessity of increasing the capacity of the power supply.

The parameters of the elements of FIG. 2 which do not appear in FIG. 1 are as follows:

| element | value of No. |
|---|---|
| $D_5$ | IN5248 |
| $R_{12}$ | 220 K |
| $R_{13}$ | 220 K |
| $R_{14}$ | 15 ohms |
| $R_{15}$ | 10 K |
| $R_{16}$ | 10 K |
| $Q_5$ | IRFD120 |
| $Q_6$ | 2N3417 |

What is claimed is:

1. An electronic horn for alarm circuits of the type in which a d.c. power supply of particular polarity indicates an alarm condition, comprising:

a pair of power supply terminals connected to said d.c. power supply;

a piezo sounder connected across said supply terminals;

an inductor connected in parallel circuit with said piezo sounder to form a tank circuit;

current control means having a set input, a reset input and an output circuit inserted in series with said parallel circuit and said supply terminals, said current control means being operable to make said output circuit conductive in response to a set pulse signal on said set input so as to initiate charging current flow through said parallel circuit when said alarm condition exists and to make said output circuit nonconductive to cut off said charging current in response to the simultaneous presence of a reset signal on said reset input and the absence of a set pulse signal on said set input;

a source of clock signals operable to periodically produce a set pulse signal to said set input, said set pulse signal being of duration sufficient to maintain said output circuit conductive for at least a period corresponding to the period when the capacitive charging current through said sounder exceeds a predetermined reset value;

reset means operable to produce a reset signal to the reset input of said control means when the current through said output circuit reaches said predetermined reset value so that said output circuit will become nonconductive when the current in said series circuit due to the charging of said inductor reaches said predetermined value after the capacitance of said sounder has been substantially charged.

2. An electronic horn for alarm circuits as set forth in claim 1 in which said current control means includes current modifying means providing said output circuit and an input terminal, said modifying means being operative to vary the conductive of said output circuit in response to the voltage at said input terminal, and a flip-flop having its set input connected to receive said set input pulse signals from said clock source, its reset input connected to receive said reset signals and its output connected to said input terminal, said flip-flop being operable to produce an output voltage representing a logical "1" unless said set input is a logical "1", as represented by a set pulse signal, and said reset input is a logical "0", as reepresented by the presence of a reset signal;

said clock signal source includes an oscillator having an output, said oscillator being operable when said alarm condition occurs to produce at its output periodic output pulses of polarity representative of a logical "0", said output pulses being produced at a frequency corresponding to the frequency desired for the fundamental audible tones of said sounder, and an RC circuit connected to the output of said oscillator and operable to produce from said logical "0" oscillator output pulses said set pulse signals; and said reset means includes means for detecting the current in said series circuit, and means operable to produce reset signals of a logical "0" significance when the current detected in said series circuit exceeds the predetermined reset value.

3. An electronic horn as set forth in claim 2 in which said means for detecting the current is a first resistor connected in said series circuit, said first resistor being of magnitude such that current of the reset value in said series circuit wil cause a voltage drop across said first resistor of an amount sufficient to cause the production of said reset signal, a first NPN transistor connected in a common emitter configuration with its base connected on the side of said first resistor which will be high when the supply is in said particular polarity, the emitter of said transistor being connected to the terminal of said supply which is low in the alarm condition, and its collector being connected through an output resistor to a source which is high during said alarm condition and to the reset input of said flip-flop so that said transistor becomes conductive when said series circuit current reaches said reset value.

4. An electronic horn as set forth in claim 3 in which said current modifying means includes a power MOSFET having its drain to source circuit forming its output circuit and its gate forming its input terminals, a second resistor connected between the base of said first NPN transistor and the side of said first resistor which is high during the alarm condition, and a second NPN transistor having its base connected to the side of the first resistor which is high when the polarity of said source is in the alarm condition, its collector connected to the gate of said MOSFET and its emitter connected to its base through said second resistor, said second resistor being of magnitude such that the conductivity of said MOSFET is modified by the current through the collector and emitter of said second transistor to limit the current in the series circuit to a predetermined amount which exceeds that required to make said first transistor conductive so that the current in the series circuit is limited to a value higher than the reset value but low enough to provide the necessary limiting of the current drain on the power supply during the charging period of the piezo sounder.

5. An electronic horn as set forth in claim 4 which includes a capacitor connected in shunt to said series circuit to serve to smooth out the variations in the supply, a third resistor, and another current modifying means having an input terminal and an output circuit which provides a conductive path which connects through a fourth resistor between the terminal of the power supply which is low during alarming and the side of the parallel circuit which is low during alarming, and an input terminal connected through said third resistor to the side of said parallel circuit which is high during alarming.

6. An electronic horn as set forth in claim 5 in which said other current modifying means includes a second power MOSFET having a drain to source circuit forming its output circuit and a gate forming its input circuit, a third NPN transistor having its base connected to the side of said third resistor which is high when the polarity of said source is in the alarm condition, its collector connected to the gate of said second MOSFET and its emitter connected to its base through said fourth resistor.

7. An electronic horn as set forth in claim 6 in which said other current modifying means also includes a fifth resistor connected in series between the side of said fourth resistor which is high during alarming and the base of said third transistor, a sixth resistor connected between the gate of said second MOSFET and the collector of said third transistor, and a zener diode connected between the source and gate of said second MOSFET, said fifth and sixth resistors and said diode being effective to provide overcurrent and voltage protection for said third transistor and said second MOSFET.

8. An electronic horn for alarm circuits of the type in which a d.c. power supply of particular polarity indicates an alarm condition, comprising:

a pair of power supply terminals connected to said d.c. power supply;

a piezo sounder connected across said supply terminals;

an inductor connected in parallel circuit with sai piezo sounder to form a tank circuit; and current control means inserted in series circuit with said parallel circuit and said power supply terminals and operable during said alarm condition to become periodically conductive so as to allow a current flow from said supply through said parallel circuit for a period corresponding to the period required to charge the capacitance of said sounder and to bring the current flow through said inductor to a predetermined value and to become nonconductive so as to cut off said current flow when the current through said inductor reaches said predetermined value to allow said tank circuit to go into decaying oscillation at its natural frequency until the beginning of the next period when said control means again becomes conductive.

9. An electronic horn as set forth in claim 8 in which said periodicity of becoming conductive corresponding to the frequency desired for the fundamental tone of the sounder, and said inductor has an inductance of value such that the tank circuit will oscillate at the frequency desired for overtones in the sounder.

* * * * *